US007475645B2

(12) United States Patent
Engvall

(10) Patent No.: US 7,475,645 B2
(45) Date of Patent: Jan. 13, 2009

(54) RETRACTABLE LIQUOR GUN HOLDER FOR A RECOVERY FURNACE

(75) Inventor: Johan Engvall, Huddinge (SE)

(73) Assignee: Diamond Power International, Inc., Lancaster, OH (US)

( * ) Notice: Subject to any disclaimer, the term of this patent is extended or adjusted under 35 U.S.C. 154(b) by 513 days.

(21) Appl. No.: 11/138,044

(22) Filed: May 26, 2005

(65) Prior Publication Data

US 2005/0263108 A1 Dec. 1, 2005

Related U.S. Application Data

(60) Provisional application No. 60/575,669, filed on May 28, 2004.

(51) Int. Cl.
*F23L 5/00* (2006.01)

(52) U.S. Cl. ..... 110/182.5; 122/7 R

(58) Field of Classification Search ..... 110/182.5, 110/238, 348, 262.2, 66; 193/35 R, 37; 104/94; 122/7 R, 235.12; 239/526, 600, 432, 106, 239/104, 227, 263.2; 431/188, 189
See application file for complete search history.

(56) References Cited

U.S. PATENT DOCUMENTS 2,591,188 A 4/1952 Nilsson
3,606,162 A * 9/1971 Lehman ..... 239/227
4,416,422 A 11/1983 Tinnis
4,683,841 A 8/1987 Andersson et al.
5,551,354 A 9/1996 Crofut et al.
5,762,005 A 6/1998 Parisi et al.
5,970,578 A * 10/1999 Mensching et al. ..... 16/94 R
6,279,495 B1 8/2001 Karidio et al.
6,478,235 B1 11/2002 Soderstrom et al.
6,578,529 B2 6/2003 Hytönen et al.

* cited by examiner

*Primary Examiner*—Kenneth B Rinehart
(74) *Attorney, Agent, or Firm*—Brinks Hofer Gilson & Lione Ann Arbor

(57) ABSTRACT

A liquor gun holder for a recovery furnace includes a rail assembly, a carriage assembly moveably mounted onto the rail assembly such that the carriage assembly is moveable longitudinally along the rail assembly, a pivot pin supported by a bearing and extending laterally from the carriage assembly, and a cleaning assembly pivotally mounted onto the pivot pin such that the cleaning assembly is rotatable about a horizontal axis extending longitudinally through the pivot pin and is positioned laterally from the carriage assembly and the rail assembly, the cleaning assembly including a clamp adapted to secure a liquor gun thereon such that the liquor gun is rotatable with the cleaning assembly and is positioned laterally from the carriage assembly.

19 Claims, 3 Drawing Sheets

RETRACTABLE LIQUOR GUN HOLDER FOR A RECOVERY FURNACE

CROSS-REFERENCE TO RELATED PATENT APPLICATIONS

This patent application claims the benefit of U.S. provisional patent application 60/575,669, filed May 28, 2004.

FIELD OF THE INVENTION

The present invention relates generally to recovery boilers and furnaces which are used to process waste liquor, and more particularly relates to the liquor gun used to spray the waste liquor into the recovery furnace.

BACKGROUND OF THE INVENTION

Paper pulp is manufactured by treating wood in a boiling liquid at high temperatures and pressures. After the boiling process, the remaining liquid contains a number of chemicals and retains some of the wood substance, forming a "weak liquor". In a typical mill, the water is removed from the weak liquor and a "black liquor" is obtained, and is then supplied as fuel to the recovery boiler. The recovery boiler provides a reduced atmosphere at 1000° C. to burn the remaining wood substance and release energy that is conveyed away in the form of high-pressure steam. A regeneration of the chemicals contained in the black liquor is also performed in the recovery boiler.

The black liquor is normally supplied to the recovery furnace through burners commonly referred to as liquor guns. These liquor guns often include simple nozzles provided with some form of splash or deflection plate that is mounted on the nozzle. Typically, the liquor guns are mounted for rotation about a horizontal axis, whereby the vertical position of the nozzle and deflector plate may be adjusted in order to direct the spray of the black liquor. Due to the harsh environment of the mill and recovery furnace, the entire spray gun assembly, including the tilting mechanism, must be very sturdily constructed. At the same time, the harsh environment requires that the liquor guns be serviced relatively frequently. For example, the nozzle portion of the gun projects inside the recovery furnace and is constantly exposed to high temperatures and the black liquor. Thus, the nozzles need cleaning, repair or replacement.

Accordingly, there exists a need to provide a liquor gun assembly that is not only well adapted for the harsh environment of a recovery furnace, but which also facilitates access and service of the liquor gun.

BRIEF SUMMARY OF THE INVENTION

A liquor gun holder in accordance with this invention generally comprises a spray rod (splash plate cleaning device), a carriage assembly and a rail assembly. The spray rod and gun holder is rotatably connected to the carriage assembly. The carriage assembly is mounted to the rail assembly for linear translation relative to a wall of the recovery furnace. The liquor gun thus includes a retractable spray rod which may be translated from an active position where its nozzle is positioned within the interior chamber of the furnace, to a service position where the spray rod is retracted and the nozzle is outside the chamber. The retractable spray rod permits service on liquor gun, including the nozzle of the spray rod.

According to more detailed aspects, the carriage assembly includes a tilting mechanism which allows the spray rod and gun holder to be tilted relative to a horizontal axis. Preferably, the tilting mechanism and the carriage assembly are positioned laterally (i.e. to the side) of the spray rod. When a cleaning assembly is provided to remove accumulated black liquor from the deflector plate, the cleaning assembly is preferably vertically aligned with the spray rod, and thus also positioned laterally from the carriage assembly. In this manner, the spray rod and cleaning assembly may be tilted, while at the same time permitting axial translation of the spray rod and scraper assembly via the carriage and rail assemblies which are positioned to prevent interference with the spray rod.

According to even further aspects of the invention, the rail assembly is preferably positioned vertically below the carriage assembly, and importantly is also positioned laterally from the spray rod. The rail assembly typically includes a connection plate and tab which correspond with vertically extending mounting plates attached to a wall plate of the recovery furnace wall. The wall plate generally includes an elongated slot or aperture for providing access to the interior chamber of the recovery furnace. While the nozzle of the spray rod must be aligned with this opening for spraying black liquor into the furnace, the carriage assembly and rail assembly are preferably laterally positioned from the spray rod so that these mechanisms are not aligned with the opening, and thereby partially sheltered from that environment. At the same time, the retraction of the spray rod and its nozzle does not cause any black liquor to leak or seep onto the carriage assembly or rail assembly, as they are laterally positioned therefrom.

DETAILED DESCRIPTION OF THE INVENTION

Figure 1:
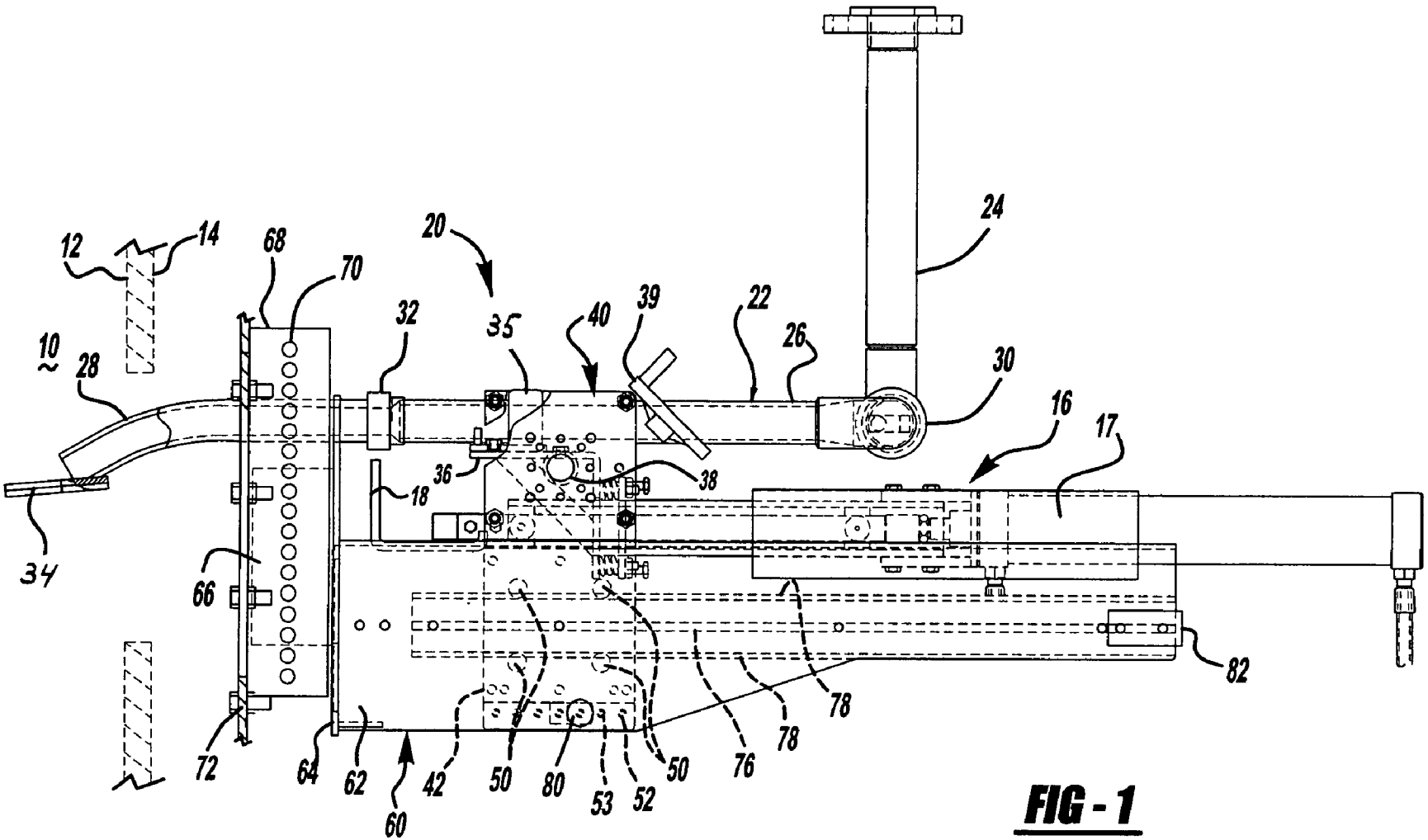
FIG. 1 is a side view, partially in cross-section and partially in hidden, of a liquor gun constructed in accordance with the teachings of the present invention.
Figure 2:
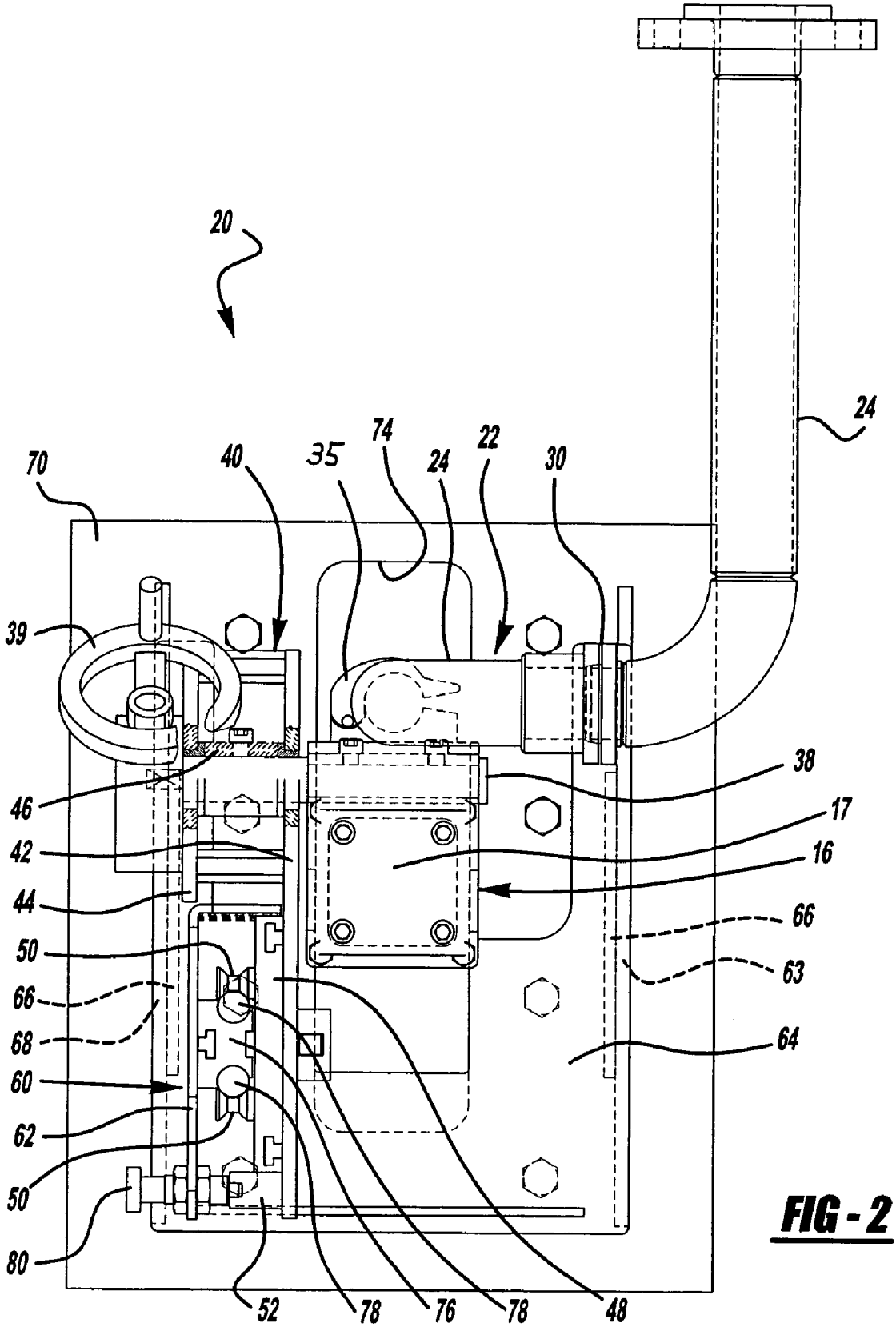
FIG. 2 is an end view of the liquor gun depicted in FIG. 1.

Turning now to the figures, FIGS. 1 and 2 depict side and end views of a liquor gun holder 20 designed to support a liquor gun 22 to provide black liquor to the internal chamber 10 defined by the exterior wall 12 of a recovery furnace. The liquor gun holder 20 generally comprises a cleaning assembly 16 connected to a carriage assembly 40, which in turn is connected to a rail assembly 60 for linear translation of the cleaning assembly 16 relative to the chamber 10 of the furnace. FIG. 1 depicts the cleaning assembly 16 and carriage assembly 40 in an extended active position.

The liquor gun 22 generally comprises an inlet tube 24 fluidically connected to a spray tube 26, which in turn is fluidically connected to a nozzle 28. The inlet tube 24 is connected to the spray tube 26 by way of a hinge coupling 30 which allows the inlet tube 24 and spray tube 26 to rotate relative to one another. The nozzle 28 is coupled to the spray tube 26 by way of a coupling 32, thereby allowing the nozzle 28 to be individually replaced or repaired. The nozzle 28 projects through a port 14 formed in the exterior wall 12 of the recovery furnace. The distal end of the nozzle 28 includes a deflector plate 34 as is known in the art for forming a spray pattern with the black liquor to promote vaporization and recovery in the recovery furnace.

The liquor gun 22 is connected to the carriage assembly 40 by way of a clamp 35. The clamp 35 is secured to the horizontal arm of an L-shaped bracket 36. The downwardly depending arm of the L-shaped bracket 36 is mechanically connected to the cleaning assembly 16 which includes a cylinder 17 operatively connected to a scraper or cutting head 18. As is known in the art, the cleaning assembly 16 translates the cutting head 18 into engagement with the deflector plate 29 to scrape the deflector plate 34 and free any black liquor or other debris that has collected thereon. In sum, the liquor gun 22 and cleaning assembly 16 are rigidly connected by way of the L-shaped bracket 36.

The L-shaped bracket 36 is attached to a pivot pin 38 which extends laterally from the cleaning assembly 16, as best seen in FIG. 2. The carriage assembly 40 includes opposing first and second plates 42, 44 which have a bearing 46 extending therebetween for receiving the pivot pin 38. Accordingly, it will be seen that the cleaning assembly 16 and the liquor gun 22 are thus pivotally connected to the carriage assembly 40 by way of the pivot pin 38 and the bearing 46. As is known in the art, the cleaning assembly 16 and the liquor gun 22 are rotatable about a horizontal axis defined by the pivot pin 38 to change the position of the nozzle 28. The carriage assembly 40 includes a mechanism to rotate the cleaning assembly 16 and the liquor gun 22 and to secure the cleaning assembly 16 and the liquor gun 22 in a particular pivoted position. As shown, a crank 39 is rotated to drive a toothed shaft (not shown), which in turn drives a gear mechanism (not shown) housed in the carriage assembly 40 between the opposing plates 42, 44.

The first plate 42 extends downwardly from the pivot pin 38 and the bearing 46 for connection to the rail assembly 60, as will be described below. As best seen in FIG. 1, the rail assembly 60 generally includes a bracket 62 attached to a connection plate 64. The connection plate 64 includes a pair of distally projecting tabs 66 for attaching the rail assembly 60 to a wall plate 72 forming a portion of the furnace wall 12. The wall plate 72 defines an elongated slot or aperture 74 (FIG. 2) providing access to the internal chamber 10 of the recovery furnace. The wall plate 72 includes a pair of opposing mounting plates 68 having a plurality of apertures 70 which are vertically spaced. The mounting plates 68 receive the tabs 66, and the plurality of apertures 70 allow the rail assembly 60 to be vertically positioned relative to the furnace and internal chamber 10. This in turn allows the liquor gun holder 20 to be vertically positioned on the furnace.

Referring now to FIG. 2, an end view of the rail assembly 60 can be seen. The bracket 62 includes a rail 76 projecting laterally therefrom, the rail including a pair of opposing guides 78. The guides 78 each preferably comprise a cylindrically shaped metal rod which provides stable translation of the carriage assembly 40 relative to the rail assembly 60. It can also be seen in FIG. 2 that the first plate 42 of the carriage 40 includes an axle plate 48 which supports a pair of opposing rollers 50 shaped to correspond with the guides 78. The rollers 50 translate over with the guides 78 formed in the rail 76. A stop 82 is positioned at a proximal end of the rail 76 to prevent inadvertent removal of the carriage assembly 40, cleaning assembly 16, and liquor gun 22 therefrom. The liquor gun holder 20 is structured for manual translation of the liquor gun 22 and carriage assembly 40, although a motor or other mover can be employed to facilitate the withdrawal of the liquor gun 22 from the recovery furnace.

A block 52 is connected to a lower end of the first plate 42, and includes a plurality of apertures 74 as seen in FIG. 1. In this way, a pin 80 may be fitted through the bracket 62 of the rail and positioned within one of the apertures 74 of the block 52. Thus, the pin 80 and block 52 form a lock which fixes the position of the carriage assembly 40, cleaning assembly 16, and liquor gun 22 relative to the rail assembly 60. Other locking mechanisms will be readily envisioned by those of ordinary skill in the art.

Figure 3:
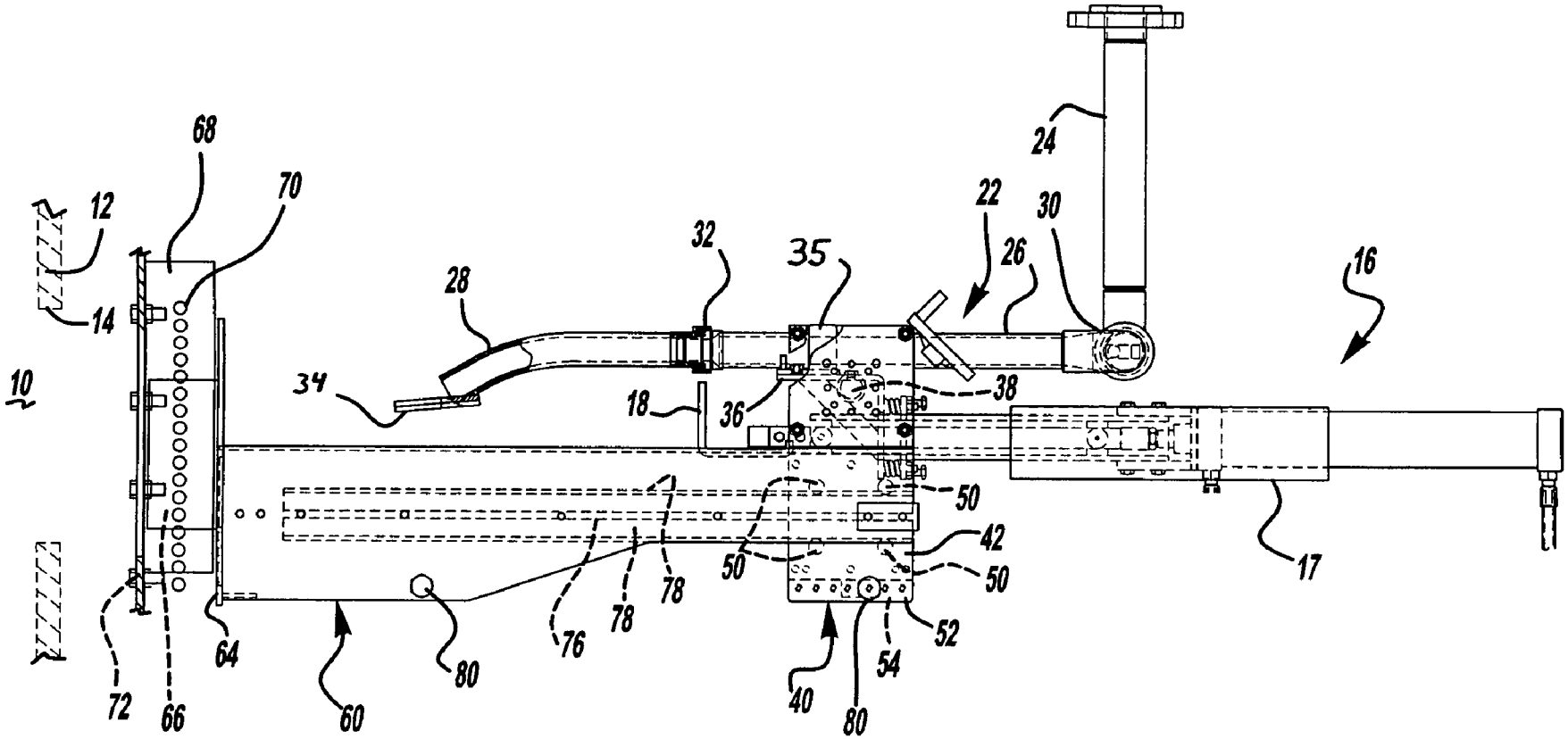
FIG. 3 is a side view partially in cross-section and partially in hidden, showing the liquor gun of FIG. 1 in a retracted service position.

In operation, the liquor gun holder 20 permits axial, preferably horizontal, translation of the cleaning assembly 16 and the liquor gun 22 via the carriage assembly 40, to selectively position the liquor gun 22 relative to the internal chamber 10 of the recovery furnace. A retracted service position of the liquor gun 22 and carriage assembly 40 has been depicted in FIG. 3. As shown, both the liquor gun 22 as well as the cleaning assembly 16 may be horizontally adjusted relative to the internal chamber 10, and to move the nozzle 28 into or out of the internal chamber 10 of the recovery furnace. In, the service position, the ports into the furnace may be closed off, and the liquor gun 22 allowed to cool prior to servicing. Furthermore, the cleaning assembly 16 may be activated while the liquor gun 22 is in either the active or service positions. As is known, the liquor gun 22 is periodically purged with steam to clean the interior passageway of the liquor gun 22.

In addition to the axial translation of the liquor gun 22 described above, the carriage assembly 40 and its tilt mechanism (not shown) permit the liquor gun 22, and the cleaning assembly 16, to be rotated about a horizontal axis defined by the pivot pin 38. The opening 71 formed in the wall plate 72, as well as the port 14 defined in the furnace wall 12, are sized to permit the axial translation of the liquor gun 22 and carriage assembly 40 relative to the rail assembly 60 regardless of whether the liquor gun 22 is in a horizontal or tilted position. Likewise, the ability to tilt as well as axially translate the liquor gun 22, either sequentially or simultaneously, is permitted by virtue of placing the carriage assembly 40 and corresponding rail assembly 60 laterally from the cleaning assembly 16 and the liquor gun 22, as best seen in the end view of FIG. 2.

It will also be seen that the opposing plates 42, 44 of the carriage assembly 40, which house the bearing 46 and gearing assembly for tilting the cleaning assembly 16 and the liquor gun 22, are vertically positioned above the rail assembly 60, and in particular the rail 76 and guides 78. Accordingly, the liquor gun 22 may be translated horizontally and away from the internal chamber 10 of the recovery furnace, to thereby allow service or replacement of the liquor gun 22 as well as cleaning or other maintenance. At the same time, the liquor gun 22 may be tilted and the carriage assembly 40, including the tilting mechanism, and rail assembly 60 are protected from the harsh environment of the recovery furnace.

I claim:

1. A liquor gun holder for a recovery furnace comprising:

a rail assembly;

a carriage assembly moveably mounted onto the rail assembly such that the carriage assembly is moveable longitudinally along the rail assembly between an active position wherein the liquor gun holder nositions a liquor gun inside the furnace and a service position wherein the liquor gun holder positions the liquor gun outside the furnace;

a pivot pin supported by a bearing and extending laterally from the carriage assembly;

a cleaning assembly pivotally mounted onto the pivot pin such that the cleaning assembly is rotatable about a horizontal axis extending longitudinally through the pivot pin and is positioned laterally from the carriage assembly and the rail assembly, the cleaning assembly including a clamp adapted to secure the liquor gun thereon such that the liquor gun is rotatable with the cleaning assembly and is positioned laterally from the carriage assembly, and a connection plate mounted to a distal end of the rail assembly proximate the recovery furnace, the connection plate including distally projecting tabs for attaching the rail assembly to an exterior wall of the recovery furnace.

2. The liquor gun holder of claim 1 wherein the carriage assembly is positioned vertically above the rail assembly.

3. The liquor gun holder of claim 1 wherein the cleaning assembly includes a cutting head mounted onto a cylinder, wherein the cylinder is adapted to selectively move the cutting head into engagement with a deflector plate for a nozzle of the liquor gun.

4. The liquor gun holder of claim 3 wherein the cutting head of the cleaning assembly can be moved into engagement with the deflector plate with the carriage assembly positioned at any point along the rail assembly.

5. The liquor gun holder of claim 4 wherein the cutting head of the cleaning assembly is moveable into engagement with the deflector plate in any pivotal position.

6. The liquor gun holder of claim 1 further including a mechanism to adjust the pivotal position of the cleaning assembly and to secure the cleaning assembly and the liquor gun in a particular pivotal position.

7. The liquor gun holder of claim 1 wherein the cleaning assembly and the liquor gun is mounted thereon and can be moved longitudinally along the rail assembly and pivotally rotated about the pivot pin simultaneously.

8. A liquor gun holder comprising:

a rail assembly wherein the rail assembly includes a pair of guides running longitudinally along the rail assembly spaced vertically from one another, a carriage assembly including a pair of rollers having a shape corresponding to the guides, whereby the rollers translate along the guides to allow the carriage assembly to move longitudinally along the rail assembly between an active position and a service position;

a pivot pin supported by a bearing and extending laterally from the carriage assembly; and a cleaning assembly pivotally mounted onto the pivot pin such that the cleaning assembly is rotatable about a horizontal axis extending longitudinally through the pivot pin and is positioned laterally from the carriage assembly and the rail assembly, the cleaning assembly including a clamp adapted to secure a liquor gun thereon such that the liquor gun is rotatable with the cleaning assembly and is positioned laterally from the carriage assembly.

9. The liquor gun holder of claim 8 wherein the rail assembly includes a stop positioned at a distal end thereof to selectively prevent removal of the carriage assembly from the rail assembly.

10. The liquor gun holder of claim 9 further including a locking mechanism for securing the carriage assembly and cleaning assembly in a particular position relative to the rail assembly.

11. A recovery furnace comprising:

an exterior wall defining an internal chamber;

at least one port formed within and extending through the exterior wall to allow access to the internal chamber;

a liquor gun for delivering black liquor to the internal chamber; a liquor gun holder, the liquor gun holder including a rail assembly and a carriage assembly moveably mounted onto the rail assembly such that the carriage assembly is moveable longitudinally along the rail assembly; a pivot pin supported by a bearing and extending laterally from the carriage assembly; and a cleaning assembly pivotally mounted onto the pivot pin such that the cleaning assembly is rotatable about a horizontal axis extending longitudinally through the pivot pin and is positioned laterally from the carriage assembly and the rail assembly;

a clamp securing the liquor gun onto the cleaning assembly such that the liquor gun is rotatable with the cleaning assembly and is positioned laterally from the carriage assembly;

the liquor gun including an inlet tube connected to and in fluid communication with a spray tube that is connected to and in fluid communication with a nozzle, the inlet tube and the spray tube being pivotally connected to one another and the nozzle including a deflector plate mounted to a distal end thereof;

the cleaning assembly including a cutting head mounted onto a cylinder, wherein the cylinder is adapted to selectively move the cutting head into engagement with the deflector plate to clean the deflector plate; and a connection plate mounted to a distal end of the rail assembly proximate the recovery furnace, the connection plate including distally projecting tabs for attaching the rail assembly to the exterior wall of the recovery furnace.

12. The recovery furnace of claim 11 further including a wall plate mounted to the exterior wall of the recovery furnace and having an aperture formed therein and aligned with the port of the recovery furnace, the wall plate including mounting plates having a plurality of vertically spaced apertures formed therein, the apertures adapted to engage the tabs of the connection plate to allow the rail assembly to be vertically positioned relative to the port.

13. A recovery furnace comprising:

an exterior wall defining an internal chamber;

at least one port formed within and extending through the exterior wall to allow access to the internal chamber;

a liquor gun for delivering black liquor to the internal chamber;

a liquor gun holder, the liquor gun holder including a rail assembly wherein the rail assembly includes a Dair of guides running longitudinally along the rail assembly sDaced vertically from one another and a carriage assembly moveably mounted onto the rail assembly such that the carriage assembly is moveable longitudinally along the rail assembly; the carriage assembly including a pair of rollers having a shane corresnonding to the guides, whereby the rollers translate along the guides to allow the carriage assembly to move longitudinally along the rail assembly the rail assembly includes a ston nositioned at a distal end thereof to selectively Drevent removal of the carriage assembly from the rail assembly, a pivot pin supported by a bearing and extending laterally from the carriage assembly; and a cleaning assembly pivotally mounted onto the pivot pin such that the cleaning assembly is rotatable about a horizontal axis extending longitudinally through the pivot pin and is positioned laterally from the carriage assembly and the rail assembly;

a clamp securing the liquor gun onto the cleaning assembly such that the liquor gun is rotatable with the cleaning assembly and is positioned laterally from the carriage assembly;

the liquor gun including an inlet tube connected to and in fluid communication with a spray tube that is connected to and in fluid communication with a nozzle, the inlet tube and the spray tube being pivotally connected to one another and the nozzle including a deflector plate mounted to a distal end thereof;

the cleaning assembly including a cutting head mounted onto a cylinder, wherein the cylinder is adapted to selectively move the cutting head into engagement with the deflector plate to clean the deflector plates.

14. The assembly of claim 13 wherein the carriage assembly is positioned vertically above the rail assembly.

15. The assembly of claim 13 wherein the cutting head of the cleaning assembly can be moved into engagement with the deflector plate with the carriage assembly positioned at any point along the rail assembly.

16. The assembly of claim 15 wherein the cleaning assembly is mounted onto the pivot pin to rotate with the spray tube, the cutting head of the cleaning assembly being moveable into engagement with the deflector plate in any pivotal position.

17. The assembly of claim 13 further including a mechanism to adjust the pivotal position of the spray tube and to secure the spray tube in a particular pivotal position.

18. The assembly of claim 13 wherein the carriage assembly, the cleaning assembly, and the liquor gun can be moved longitudinally along the rail assembly simultaneously as the cleaning assembly and liquor gun are pivotally rotated about the pivot pin.

19. The recovery furnace of claim 13 further including a locking mechanism for securing the carriage assembly, the cleaning assembly, and the liquor gun in a particular position relative to the rail assembly.

* * * * *

UNITED STATES PATENT AND TRADEMARK OFFICE

CERTIFICATE OF CORRECTION

PATENT NO. : 7,475,645 B2
APPLICATION NO. : 11/138044
DATED : January 13, 2009
INVENTOR(S) : Johan Engvall It is certified that error appears in the above-identified patent and that said Letters Patent is hereby corrected as shown below:

In the Claims

In column 4, claim 1, line 56, after "gun holder" delete "nositions" and substitute --positions-- in its place.

In column 6, claim 13, line 40, after "assembly includes" delete "Dair" and substitute --pair-- in its place.

In column 6, claim 13, line 42, before "vertically from" delete "sDaced" and substitute --spaced-- in its place.

In column 6, claim 13, line 46, after "rollers having a" delete "shane corresnonding" and substitute --shape corresponding-- in its place.

In column 6, claim 13, line 50, after "includes a" delete "ston nositioned" and substitute --stop positioned-- in its place.

In column 6, claim 13, line 51, after "selectively" delete "Drevent" and substitute --prevent-- in its place.

Signed and Sealed this

First Day of September, 2009

David J. Kappos

David J. Kappos
*Director of the United States Patent and Trademark Office*